United States Patent [19]

Koenuma

[11] 4,270,277

[45] Jun. 2, 1981

[54] UNIVERSAL PARALLEL RULER WITH CONVERTED DISPLAY OF DISPLACEMENT

[75] Inventor: Masao Koenuma, Tokyo, Japan

[73] Assignee: Asahi Seimitsu Kabushiki Kaisha, Tokyo-to, Japan

[21] Appl. No.: 105,140

[22] Filed: Dec. 19, 1979

Related U.S. Application Data

[62] Division of Ser. No. 28,353, Apr. 9, 1979, Pat. No. 4,221,056.

[30] Foreign Application Priority Data

Apr. 12, 1978 [JP] Japan ..... 53-42022
May 1, 1978 [JP] Japan ..... 53-52482

[51] Int. Cl.[3] ..... B43L 13/02
[52] U.S. Cl. ..... 33/439; 33/1 M
[58] Field of Search ..... 33/1 M, 438–442

[56] References Cited

U.S. PATENT DOCUMENTS 3,178,825 4/1965 Hislop ..... 33/440
3,944,798 3/1976 Eaton ..... 33/1 M X

*Primary Examiner*—Harry N. Haroian
*Attorney, Agent, or Firm*—Birch, Stewart, Kolasch & Birch

[57] ABSTRACT

A universal parallel ruler is disclosed. It is an arm-type ruler and includes a first base attached to a drawing board, a first arm attached to the first base, a second base attached to the opposite end of the first arm, a second arm attached on one end to the second base, and a third base attached to the opposite end of the second arm. The third base includes a lead having an x-scale and y-scale attached thereto. The scales define an (x,y) coordinate system. When the x and y scales are horizontal and vertical, respectively, a point (X,Y) may be selected on a set of (x,y) coordinate axes defined by the scales. If the scales are tilted by $\theta$ degrees, the position of the point (X,Y) may be determined along a new set of coordinate axes defined by the tilt angle $\theta$ of the scales and may be identified by a new coordinate point (x,y) relative to the new coordinate axes as follows:

$$X = L_1 \cos \theta_1 + L_2 \cos \theta_2$$

$$Y = L_1 \sin \theta_1 + L_2 \sin \theta_2$$

$$x = X \cos \theta + Y \sin \theta$$

$$y = Y \cos \theta - X \sin \theta$$

where $L_1$ and $L_2$ are the lengths of the first arm and second arm, respectively, and $\theta_1$ and $\theta_2$ are the angles between the first and second arms, respectively, and a horizontal line.

3 Claims, 11 Drawing Figures

FIG. 3
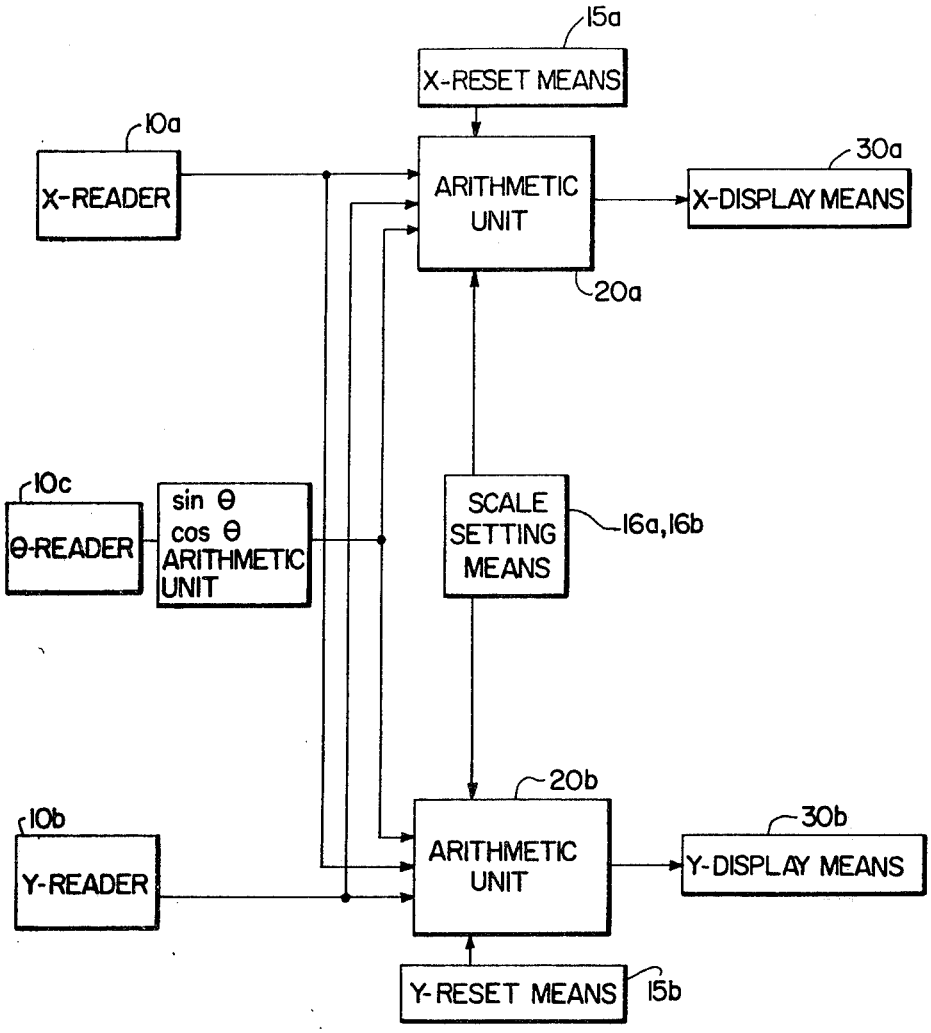
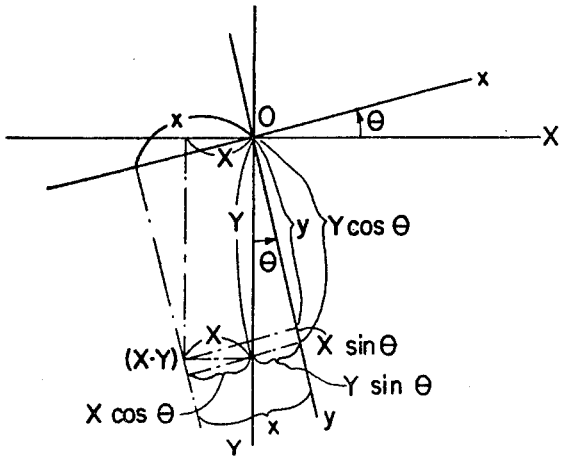
FIG. 8

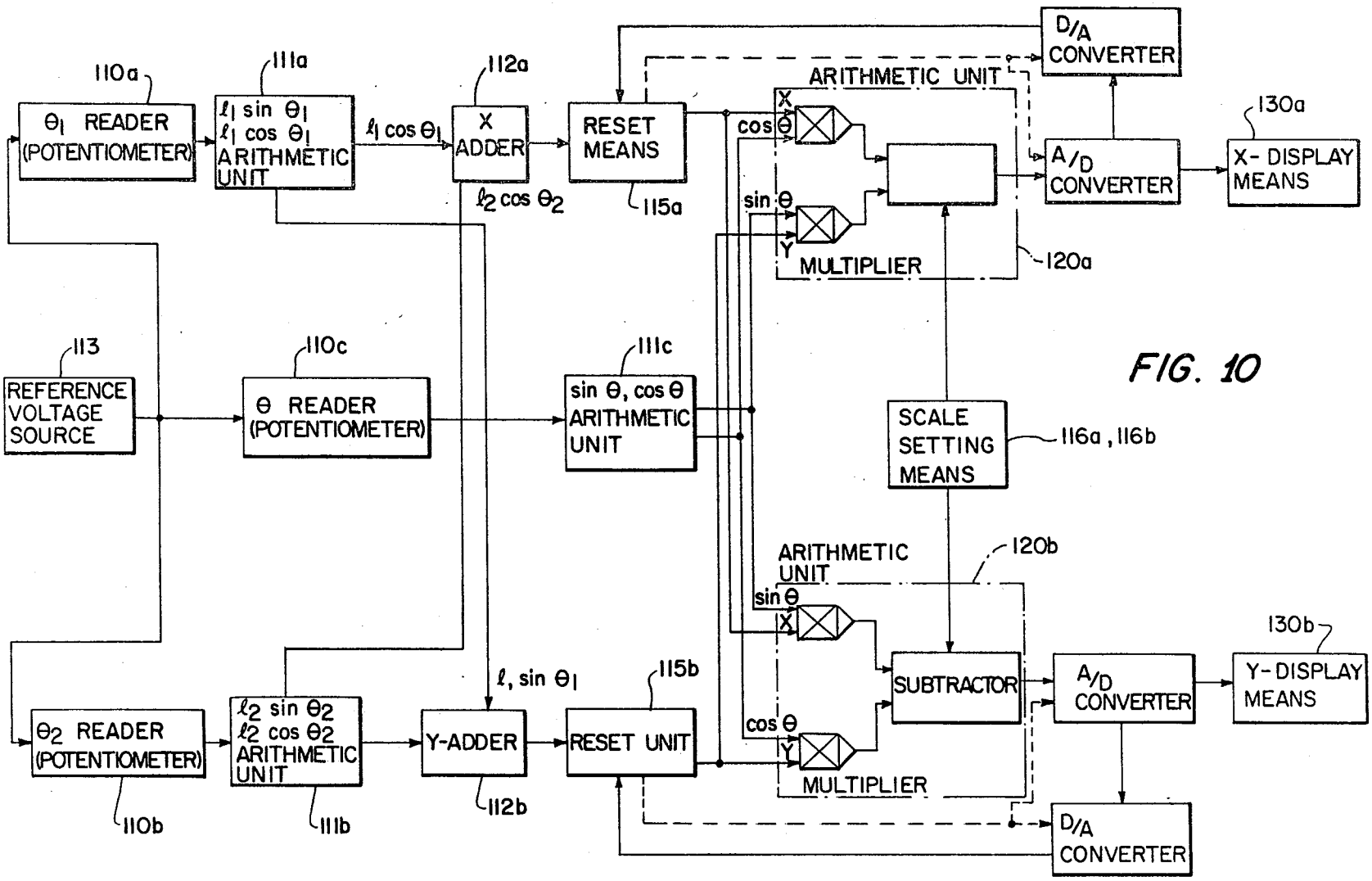
FIG. 10
X-DISPLAY MEANS
130a
Y-DISPLAY MEANS
130b
D/A CONVERTER
A/D CONVERTER
A/D CONVERTER
D/A CONVERTER
ARITHMETIC UNIT
120a
116a, 116b
SCALE SETTING MEANS
120b
SUBTRACTOR
ARITHMETIC UNIT
MULTIPLIER
MULTIPLIER
X
Y
cos θ
sin θ
sin θ
cos θ
RESET MEANS
115a
111c
sin θ, cos θ ARITHMETIC UNIT
115b
RESET UNIT
112a
X ADDER
ℓ2 cos θ2
ℓ1 sin θ1
Y-ADDER
112b
ℓ1 cos θ1
111a
ℓ1 sin θ1 ℓ1 cos θ1 ARITHMETIC UNIT
110c
θ READER (POTENTIOMETER)
ℓ2 sin θ2 ℓ2 cos θ2 ARITHMETIC UNIT
111b
110a
θ1 READER (POTENTIOMETER)
113
REFERENCE VOLTAGE SOURCE
θ2 READER (POTENTIOMETER)
110b

UNIVERSAL PARALLEL RULER WITH CONVERTED DISPLAY OF DISPLACEMENT

This application is a divisional of copending application Ser. No. 28,353, filed on Apr. 9, 1979 now U.S. Pat. No. 4,221,056.

BACKGROUND AND SUMMARY OF THE INVENTION

The present invention relates to a universal parallel ruler adapted to display scale displacement, eliminating a need to read scale graduations.

When a line is drawn and is spaced from a standard line in a drawing operation utilizing the universal parallel ruler of the prior art, it has usually been necessary to perform a plotting operation by determining the dimension from the drawn line to the standard line utilizing scale graduations and then by drawing the desired line while displacing the scale to the plotted position. Thus, the operation of reading and plotting the dimension from the standard line to the drawn line using the scale graduations required considerable skill and concentrated attention.

Accordingly, these problems associated with the universal parallel ruler of the prior art have been overcome by virtue of the present invention described hereinbelow.

In general, a track type universal parallel ruler has an X axis rail and a Y axis rail being arranged in perpendicular relationship with each other, any one of these rails being stationary and the other being displaceably guided while being maintained in perpendicular relationship with the stationary rail, and a head including scales together displaceably mounted along said displaceable rail. Assume that the scales are X- and Y-scales parallel to the X- and Y-rails, respectively, and that the X-rail is stationary. A displacement of the Y-rail relative to the X-rail directly corresponds to a displacement of the Y-scale and a displacement of the head relative to the Y-rail directly corresponds to a displacement of the Y-scale. Thus, according to the present invention the respective displacements of the X- and Y-scales can be immediately obtained without reading the scale graduations by reading the respective displacements of the Y-rail and the head with associated readers and digitally displaying them on a display mounted, for example, on the head. Furthermore, the position of the standard or reference line for each scale can be freely changed by resettably arranging the display. It is also possible to make a drawing in the reduced or multiplied unit dimension only by displacing the scales in accordance with the information displayed on the display when the display is adapted to provide display information multiplied by a given multiplier.

Accordingly, one object of the present invention is to provide a universal parallel ruler wherein it is no longer necessary to pre-plot the dimension of a drawn line relative to the standard line utilizing the scale graduations as was necessary in prior art universal parallel rulers.

Another object of the invention relates to the provision of a digital read-out of the displacement of the x and y scales wherein the displacements of the head relative to the movable rail and the displacement of the x-scale and the y-scale relative to the head have been taken into consideration.

Another object of the present invention relates to a resetting means wherein it is possible to change the position of the standard or reference x and y axes at the will of the user.

Still another object of the present invention involves the ability to utilize and compensate for a reduced or multiplied scale, to digitally read-out an x and y coordinate dimension in the reduced or multiplied scale setting on a digital display.

Other objects and further scope of applicability of the present invention will become apparent from the detailed description given hereinafter; it should be understood, however, that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

FIG. 3 illustrates an important part thereof in a block diagram;

FIGS. 7 and 8 illustrate another principle of operation of the present invention;

FIG. 10 illustrates an important part of an embodiment of the present invention.

DETAILED DESCRIPTION OF THE INVENTION

Figure 1:
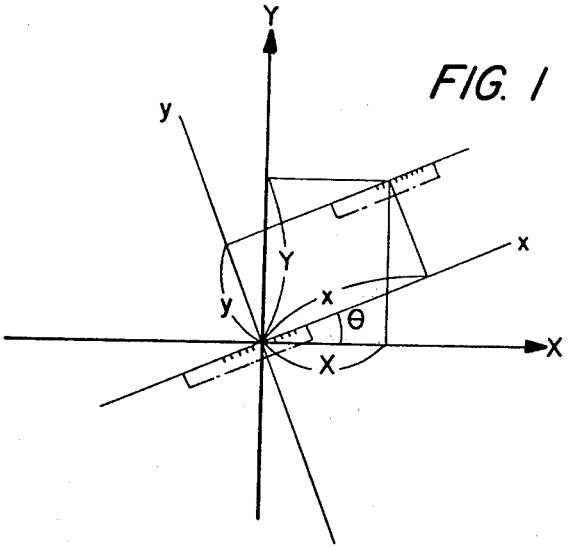
FIG. 1 illustrates the principle of the present invention.

In general operation of drawing, the standard line is not necessarily in coincidence with the X-rail or the Y-rail. The standard line of drawing may have a tilt with respect to the X-rail or the Y-rail or a drawing may be made in accordance with a standard line which is rotated by a given angle relative to the X-rail or Y-rail. In such case, it is necessary to determine a displacement in direction of the X-scale or the Y-scale which has been rotated by the given angle relative to the head. As shown by FIG. 1, coordinates (x, y) on the rectangular coordinate axes have been rotated by an angle $\theta$ around an original point defined by coordinates (X, Y) on the rectangular coordinate axes and have a common original point relative to said (X, Y) coordinates and are parallel to the X axis rail and the Y axis rail corresponding to the desired displacement. The relationships between both coordinates are expressed by the equations:

$$x = Y\cos\theta + Y\sin\theta$$

$$y = Y \cos \theta - Y \sin \theta$$

Accordingly, when the scales are displaced while being maintained at a given rotation angle relative to the head, the amount of this displacement can be visually determined on a display by provision of an arrangement such that the rotation angle of the scales relative to the head is read out by the associated reader, an arithmetic operation is performed between X and Y, which was previously read out as the displacement of the displaceable rail relative to the stationary rail and as the displacement of the head relative to the displaceable rail, respectively, and the resultant values of x and y are displayed on the display. As previously mentioned, it is also possible, in accordance with the present invention, to arrange the display such that it is a resettable display means and to provide the displayed information (representing displacement amount) as a quantity multiplied by a given multiplier.

Figure 2:
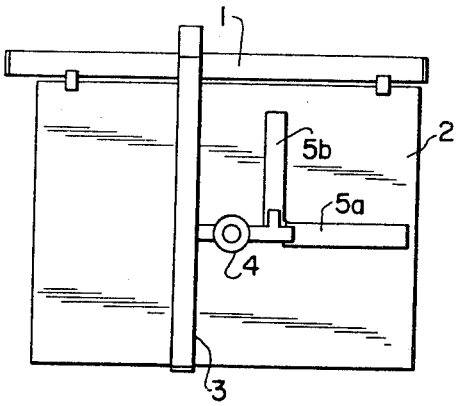
FIG. 2 schematically illustrates in a plan view the universal parallel ruler according to the present invention.

Referring to FIG. 2, reference numeral 1 designates an X axis rail stationarily mounted on a drawing board 2 and a Y axis rail 3 is displaceably guided always transversely of said X axis rail 1. Reference numeral 4 designates a head displaceably mounted along said Y axis rail 3. An X-scale 5a and a Y-scale 5b having a perpendicular relationship with each other are rotatably mounted relative to the head 4. Accordingly, where the X-scale 5a and the Y-scale 5b have been set in parallel to the x axis rail 1 and the Y axis rail 3, respectively, a displacement amount of the Y axis rail 3 relative to the X axis rail 1 corresponds to a displacement amount of the Y-scale 5b relative to rail 1 and a displacement amount of the head 4 relative to the Y axis rail 3 directly corresponds to a displacement amount of the X-scale 5a. Where the X-scale 5a and the Y-scale 5b have been set at a given angle relative to the head, on the other hand, it is necessary to obtain movement amounts of the X-scale 5a and the Y-scale 5b by angular compensation as previously mentioned.

Figure 4:
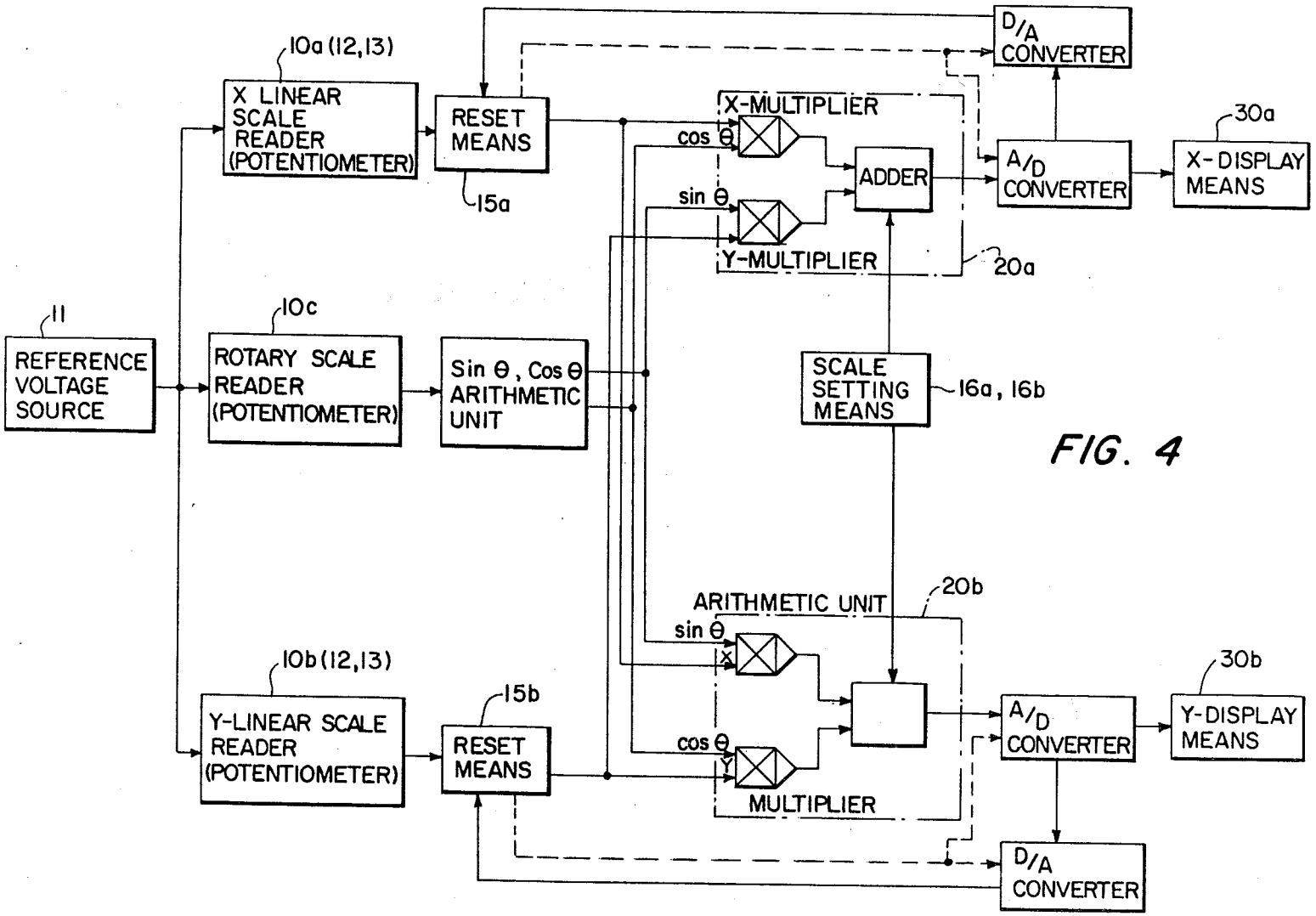
FIG. 4 illustrates an important part of an embodiment of the present invention in a block diagram.
Figure 5:
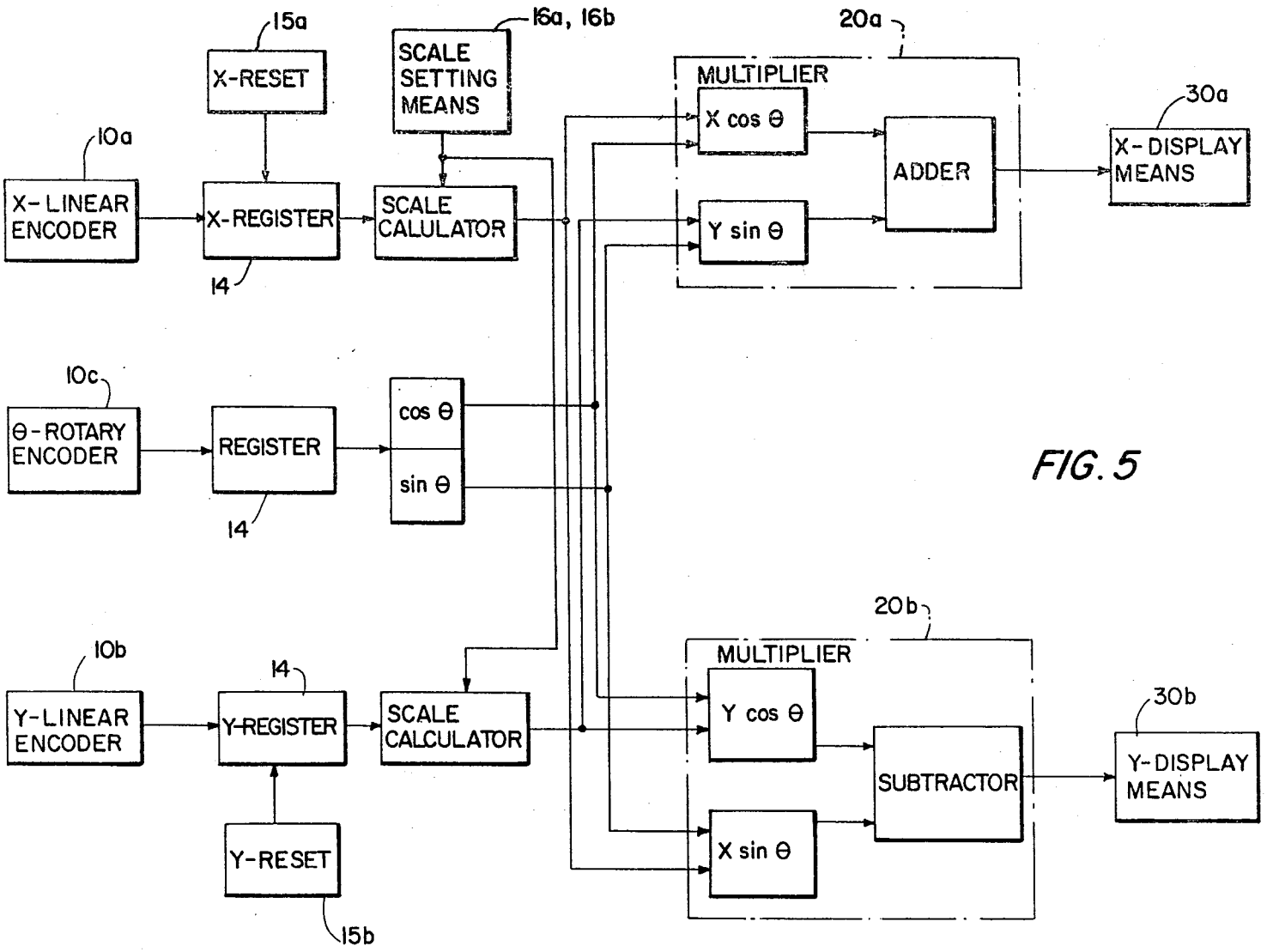
FIG. 5 similarly illustrates an important part of another embodiment of the present invention.

Referring to FIG. 3, reference numeral 10a designates a X-reader interposed between the X axis rail 1 and the Y axis rail 3 to read a displacement of the Y axis rail 3 relative to the X axis rail 1 and similarly reference numeral 10b designates a Y-reader to read a displacement of the head 4 relative to the Y axis rail 3. Such readers may comprise, as illustrated in FIG. 4, a linear scale 12 mounted along the X axis rail 1 or the Y axis rail 3 and applied with a constant voltage and a slidable electrode 13 mounted on the displaceable Y axis rail 3 or head 4 so that a variation in voltage of said slidable electrode 13 occurs as said electrode 13 slides along said linear scale 12 and may be read as an analog displacement amount, or comprise, as illustrated in FIG. 5, a linear coder mounted along the X axis rail 1 or the Y axis rail 3 and a detector element mounted on the displaceable Y axis rail 3 or head 4 so that the displacement amount may be read by said detector element as a digital amount. Furthermore, the readers may be arranged to read this amount of rotation by electrical means such as a potentiometer, after mechanical conversion of a displacement amount by a rack-and-pinion or pulley mechanism into the corresponding amount of rotation.

Referring to FIG. 3, reference numeral 10c designates a reader adapted to read a rotation angle of the X-scale 5a and the Y-scale 5b relative to the head 4, wherein a rotary encoder and a potentiometer may be used as in the cases of the readers 10a and 10b.

Signals representative of the amounts X, Y, $\theta$ read out by these readers 10a, 10b, 10c are respectively applied to arithmetic units 20a, 20b of the associated x-display and y-display so that results from operations based on $$x = X \cos \theta + Y \sin \theta$$

$$y = Y \cos \theta - Y \sin \theta$$

may be displayed by the x display and the y display, both comprising Nixie tubes or the like.

Referring to FIG. 4, in the arithmetic unit 20a of the x display 30a, X cos $\theta$ is obtained as the amount Y read by the Y-reader 10b multiplied by the amount sin $\theta$ and the displacement of the Y-scale in x direction is obtained in the form of the analog amount from the sum of both amounts X cos $\theta$ and Y sin $\theta$. This analog amount is then A-D converted so as to be displayed on the x-display 30a as the corresponding digital amount. Similarly, in the arithmetic unit 20b of the y-display 30b, multiplication of Y cos $\theta$ and Y sin $\theta$ as well as subtraction of X sin $\theta$ from Y cos $\theta$ are performed to obtain the displacement of the X-scale in y direction as the analog amount which is then A-D converted so as to be displayed on the y-display 30b as the corresponding digital amount.

In an embodiment of FIG. 5, the arithmetic units 20a, 20b are identical in their arrangements to those in the embodiment shown by FIG. 4, but the read out amounts X, Y, $\theta$ obtained by from registers 14 are digital so that the A-D conversion in FIG. 4 can be omitted.

Reset stations 15a, 15b are respectively provided between the readers 10a, 10b and the arithmetic units 20a, 20b so that said reset stations may enable reference or standard lines associated with the respective scales to be freely renewed by subtraction of the outputs from the readers 10a, 10b and storage of the result.

In the case of FIG. 4, digital signals, applied to the x-display 30a and the y-display 30b, are D-A converted into the corresponding analog signals which are then applied into the reset stations 15a, 15b. In the case of FIG. 5, on the other hand, the registers 14 are provided with the reset stations 15a, 15b, respectively, so that the display values on the x-display 30a and the y-display 30b may be reset to their reference value (0), respectively, by the associated reset switches.

The displacement amounts of the respective scales are displayed on the respective displays 30a, 30b according to a multiplied or reduced scale. Setting the scale is performed by a scale setting means 16a, 16b associated with the readers 10a, 10b, respectively, in the embodiment of FIG. 4, on the one hand, and by a similar means 16a, 16b associated with the respective registers 14 in the embodiment of FIG. 5 on the other hand. This scale setting means is based upon the digital signals present at the moment immediately before being applied to the display means 30a, 30b.

When the scales are displayed from the respective standard or reference axes in accordance with given dimensions using the universal parallel ruler of the present invention and having the arrangement as described hereinabove, the display means may be set by reset switches to have new standard or reference axes. Then the scales may be displaced relative to this new standard or reference axes until any given dimensions are displayed on the respective display means. Therefore, displacement of the scales is automatically completed, so that it is unnecessary to plot how far the respective scales should be displayed prior to actual displacement, as has conventionally been necessary, and therefore a drawing operation can be more efficiently achieved. Moreover, each of the display means is adapted, in accordance with the present invention, to display the associated displacement amount in a scale so converted that a desired drawing may be selectively made in reduced or multiplied scale by displacing the associated scale according to the displayed information which corresponds to an actual dimension. Furthermore, even when the scales have been set at a given angle relative to the X axis rail and the Y axis rail, the present invention enables the displacement amounts of the respective scales to be set at said given angle, to be displayed on the display means by provision of an arrangement such that the given angle is read, simultaneously with the rotation of the respective scales relative to the X axis rail and the Y axis rail and thereby the displacement amount X of the Y axis rail (the displaceable rail) relative to the X axis rail (the stationary rail) is read and the displacement amount Y of the head relative to the Y axis rail is read and compensated. In this manner, it is possible to perform displacement of the scales in a similar manner relative to the previously mentioned case, regardless of the angle of the scales relative to the X axis rail and the Y axis rail.

As aforementioned, the universal parallel ruler according to the present invention can achieve the initially set object and is substantially useful in practical application thereof.

Figure 6:
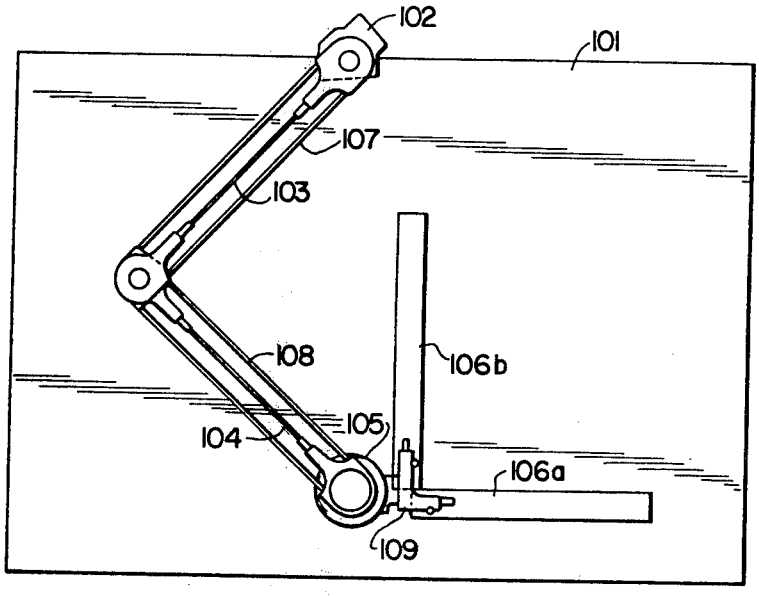
FIG. 6 is a plan view showing the arm type universal parallel ruler according to the present invention.

As shown in FIG. 6, the arm type universal parallel ruler generally has a first base 102 fixed to a drawing board 101, a first arm 103 rotatably supported at one end by said base 102, a second base mounted on an opposite end of said first arm 103 and connected by a translation mechanism to said first base 102, a second arm 104 rotatably supported at one end by said second base, a head mounted on the opposite end of said second arm 104 and connected by the translation mechanism to said second base, and scales 106*a*, 106*b* rotatably fixably mounted on said head so that said scales may be in a parallel fashion displaced on the drawing board 101. Said translation mechanism generally comprises a first pulley P1 fixed to the first base 102, a second pulley P2 of the same diameter fixed to the second base, a belt 107 extending around and between these two pulleys P1, P2 and a belt 108 extending around and between the second pulley P2 on the second base and a third pulley P3 fixed to the head 105 so that the respective pulleys are not rotatably coupled to one another and are independant of rotation of the first arm and the second arm and, as a result, the head 105 is freely and non-rotatably displaced.

Figure 7:
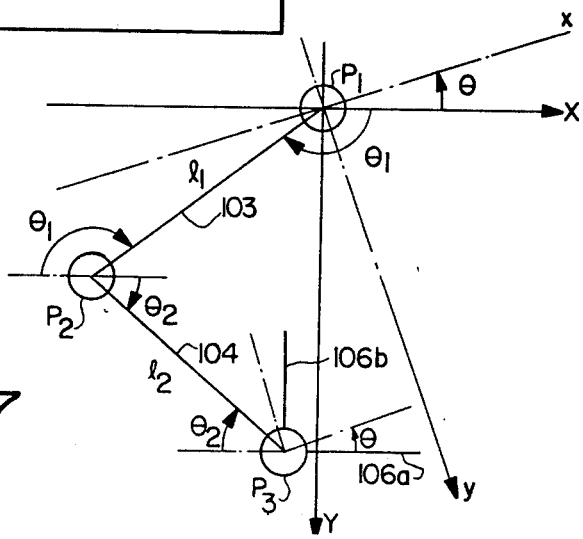

Assume that, on (X, Y) coordinates having an original point at the center of the first pulley P1 on an imaginary drawing board, as in FIG. 7 the first arm 103 has a substantial length $L_1$, the second arm has a substantial length $L_2$ and that the first and second arm 104 has a substantial length $L_2$, and that the first and second arms 103, 104 have rotation angles $\theta_1$, $\theta_2$ clockwise with respect to the X axis, the coordinates (X, Y) of the pulley 103 on the head 105 can be expressed by $$X = L_1 \cos \theta_1 + L_2 \cos \theta_2$$

$$Y = L_1 \sin \theta_1 + L_2 \sin \theta_2$$

where $L_1$, $L_2$ are constant so that the coordinates (X, Y) of the head 105 can be obtained by reading the rotation angles ($\theta_1$,$\theta_2$) of the first and second arms. Thus, displacement amounts in the X direction and the Y direction of the head 105 are obtained.

Although the coordinates (X, Y) correspond to the scale displacement amounts only when the scales 106*a*, 106*b* are in coincidence with the X, Y coordinate axes, respectively, it is sometimes necessary to set the (x, y) coordinates and to rotate the scales by an angle $\theta$ with respect to said X, Y coordinates in order to obtain variations in such x, y coordinates in accordance with the scale displacement amounts whereby the scales 106*a*, 106*b* have been fixed at said rotation angle $\theta$ with respect to the head 105, as shown by broken lines in FIG. 7. Namely, coordinates (x, y) on said x, y coordinates relative to the coordinates (X, Y) of the head can be obtained, as shown in FIG. 8, by $$x = X \cos \theta + Y \sin \theta$$

$$y = Y \cos \theta - X \sin \theta$$

Accordingly, the displacement amount of the tilted scales can be obtained by reading the title angle $\theta$ of the scales relative to the head 105 and then subjecting the previously obtained values X, Y to the arithmetic operation in accordance with the equations mentioned above.

The present invention will be now described in still greater detail with reference to the following figures of drawing.

Figure 9:
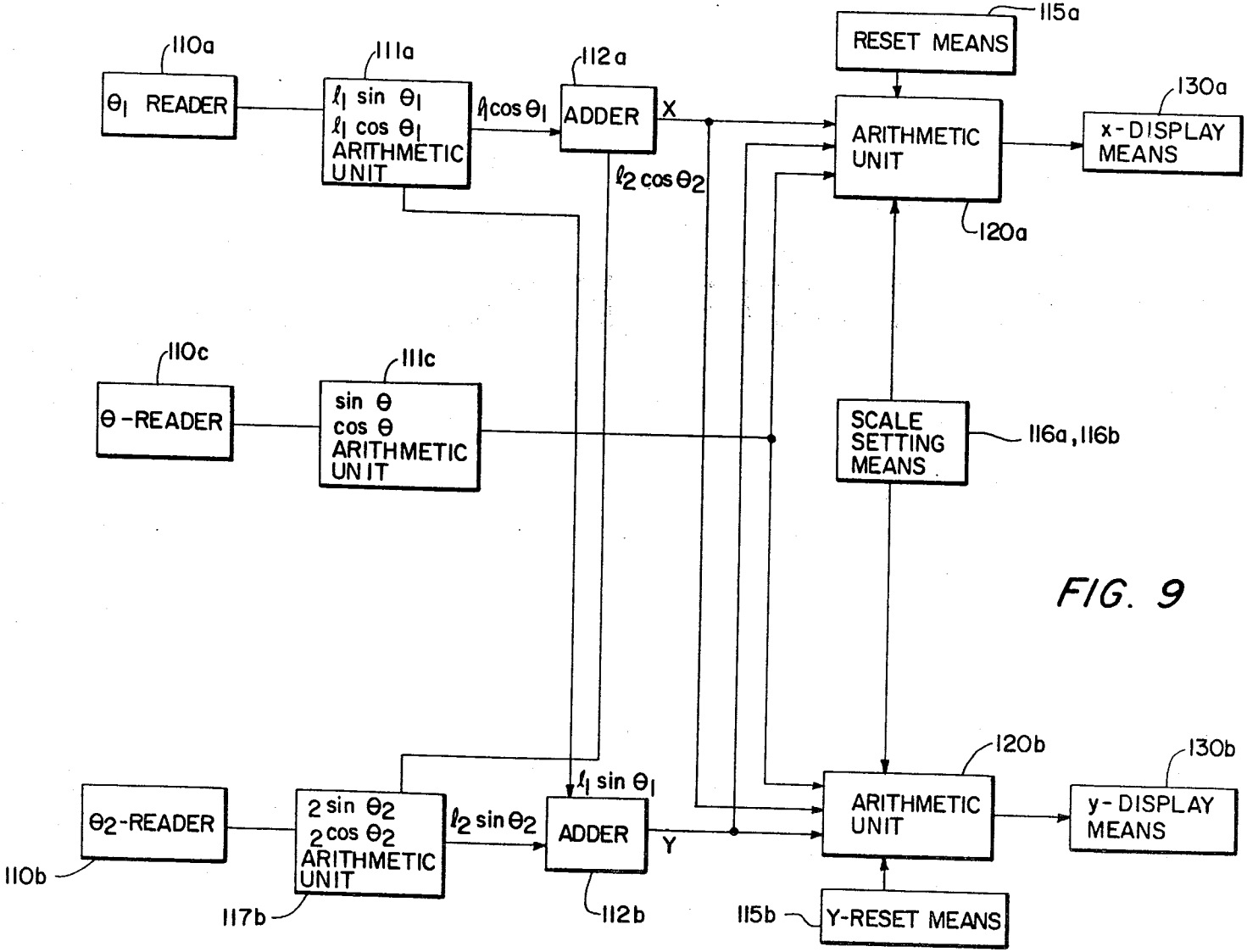
FIG. 9 illustrates an important part thereof.

Referring to FIG. 9, reference numeral 110*a* designates a reader to read a rotation angle $\theta_1$ of the first arm 103. This reader 110*a* is mounted on relatively rotatable portions of the first arm 103, or on relatively rotatable portions of the second base or the associated stationary pulley P2 and the second arm 104, or relatively rotatable portions of the head or the associated stationary pulley P3 and the second arm 104. Reference numeral 110*c* designates a reader for tilt angle $\theta$ of the scales 106*a*, 106*b*, mounted on relatively rotatable portions of the head 105 or the associated stationary pulley P3 and a scale support 109.

Each of these readers 110*a*, 110*b*, 110*c* may comprise a rotary scale mounted on one of said relatively rotatable portions, as seen in FIG. 10, so as to be applied with a constant voltage, a slidable electrode mounted on the other of said relatively rotatable portions so as to slide on said rotary scale, and a potentiometer adapted to read a voltage variation therein as an analog amount of the rotation angle, or may comprise a rotary encoder mounted on one of said relatively rotatable portions as seen in FIG. 10 and a detector element mounted on the other of said relatively rotatable portions to read the code as a digital amount of the rotation angle. Furthermore, it is also possible to interpose a gear mechanism, a pulley mechanism or the like between the relatively rotatable portions to amplify or reduce the rotation amount and then to transmit this to said potentiometer or rotary encoder.

$L_1 \sin \theta_1$ and $L_1 \cos \theta_1$ are obtained by an arithmetic unit 111*a* from an amount $\theta_1$ read by the reader 110*a* for the angle $\theta_1$ while $L_2 \sin \theta_2$ and $L_2 \cos \theta_2$ are obtained by an arithmetic unit 111*b* from an amount $\theta_2$ read by the reader 110*b* for the angle $\theta_2$. Then an adder 112*a* provides $$X = L_1 \cos \theta_1 + L_2 \cos \theta_2$$

while an adder 112*b* provides $$Y = L_1 \sin \theta_1 + L_2 \sin \theta_2$$

From an amount $\theta$ read by the reader 110c for the scale tilt angle $\theta$, an arithmetic unit 111c provides sin $\theta$ and cos $\theta$.

Signals representative of these amounts X, Y, sin $\theta$ and cos $\theta$ are applied to an arithmetic unit 120a wherein arithmetic operation $$x = X \cos \theta + Y \sin \theta$$

is performed, on one hand, and applied to an arithmetic unit 120b wherein arithmetic operation $$y = Y \cos \theta - X \sin \theta$$

is performed, on the other hand. The results of these operations are displayed by x display means 130b and y display means 130a both comprising Nixie tubes or the like as digital amounts.

Referring to FIG. 10, the arithmetic unit 120a associated with the display means 130a multiplies a sum X provided from the X-adder 12a by an amount cos $\theta$ read by the angle reader 110c to provide X cos $\theta$. And a sum Y provided from the Y-adder 112a is multiplied by sin $\theta$ to obtain Y sin $\theta$. These two sums are now added to each other to obtain a displacement amount of the Y-scale 106b in x-direction as an analog amount which is, then, A-D converted into the corresponding digital amount to be displayed on the x display means 130a. Similarly, the arithmetic unit 120b associated with the y display means 130b performs multiplication of Y cos $\theta$ and X sin $\theta$ as well as subtraction of X sin $\theta$ from Y cos $\theta$ to provide a displacement amount of the X-scale 106a in y-direction as an analog amount which is also A-D converted into the corresponding digital amount to be displayed on the y display means 30b.

Figure 11:
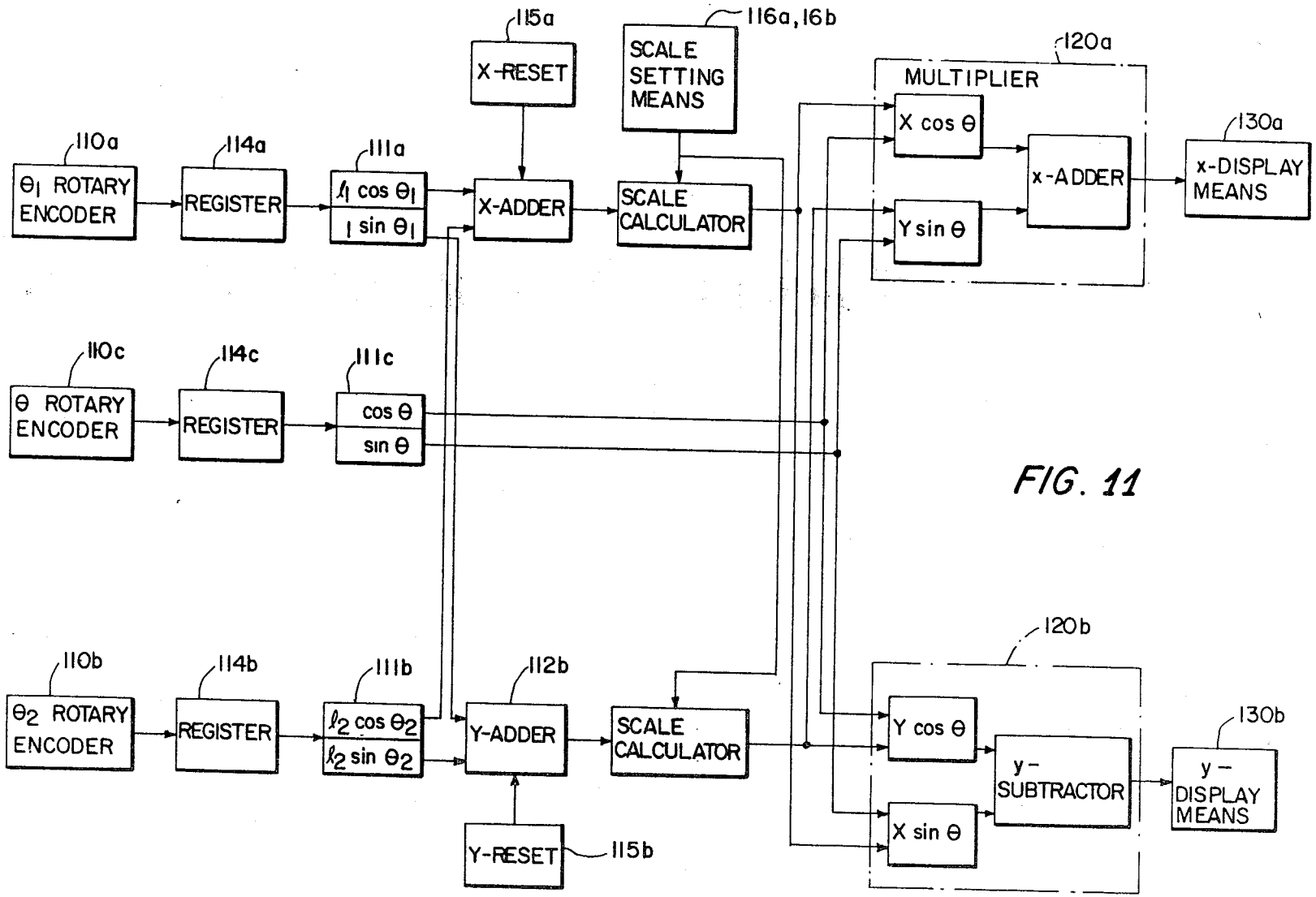
FIG. 11 similarly illustrates an important part of another embodiment of the present invention.

The arithmetic units 120a, 120b of FIG. 11 are identical in the arrangement to those in FIG. 10, except that the amounts $\theta_1$, $\theta_2$, $\theta$ are read by registers 114a, 114b, 114c and are digital amounts in the case of FIG. 11 so that A-D conversion in FIG. 5 is not necessary.

Reset stations 115a, 115b are interposed between the X, Y adders 112a, 112b and the arithmetic units 120a, 120b, respectively, to enable the standard or reference lines for scale displacement to be freely changed by subtraction of outputs from the X and Y adders 112a, 112b and storage thereof. The reference position of the corresponding X and Y axes may therefore be changed. In the case of FIG. 10, digital signals applied to the x, y display means 130a, 130b are D-A converted into the corresponding analog signals which are, in turn, applied to the reset stations 115a, 115b. In the case of FIG. 11, the reset stations 15a, 15b are associated with the X adder 112a and the Y adder 112b, respectively, and displays on the x, y display means 130a, 130b are reset by a reset switch to the reference value 0.

Scale setting for displaying the displacement of the scales on the display means 130a, 130b, selectively in a multiplied or reduced scale is effected by a scale setting means 116a, 116b associated with the arithmetic units 120a, 120b, respectively, in FIG. 10. In FIG. 11, on the other hand, the scale setting means 116a, 116b perform this operation of setting based on outputs from the X and Y adders 112a, 112b. It is obviously possible that such scale setting is based upon the digital signals at the moment immediately before being applied into the display means 130a, 130b.

When the scales are displaced from the respective standard lines in accordance with the given dimensions set within the universal parallel ruler according to the present invention and having the arrangement as described hereinabove wherein the display means are set by means such as reset switches having a standard value, respectively, then the scales may be displayed until any given dimensions are displayed on the respective display means. Therefore displacement of the scales is automatically completed. It is unnecessary to plot how far the respective scales should be displaced prior to actual displacement thereof, as has conventionally been necessary, and therefore a drawing operation can be more efficiently achieved. Moreover, each of the display means is adapted, in accordance with the present invention, to display the associated displacement amount in a scale so converted that a desired drawing may be selectively made in a reduced or multiplied scale. The associated scales may then be displaced according to the displayed information which corresponds to an actual dimension and not the reduced or multiplied dimension. Furthermore, even when the scales have been set at a given angle relative to the X axis rail and the Y axis rail, the present invention enables the displacement amounts of the respective scales thus set at said given angle to be displayed on the display means by providing an arrangement such that said given angle is read as the rotation angle of the respective scales relative to the X axis rail and the Y axis rail and thereby the displacement amount X of the Y axis rail (the displaceable rail) read relative to the X axis rail (the stationary rail) and the displacement amount Y of the head read relative to the Y axis rail are compensated. In this manner, it is possible to perform displacement of the scales in the similar manner to the previously mentioned case, regardless of the angle of the scales relative to the X axis rail and the Y axis rail.

As aforementioned, the universal parallel ruler according to the present invention can achieve the initially set object and is substantially useful in practical application thereof.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An arm type universal parallel ruler with a converted display of displacement and having a first base fixed to a drawing board, a first arm rotatably supported at one end by said first base, a second base mounted on the opposite end of said first arm and connected by a translation mechanism to said first base, a second arm rotatably supported at one end by said second base, a head mounted on the opposite end of said second arm and connected by a translation mechanism to said second base and scales rotatably and fixably mounted on said head so that said scales may be displaced in a parallel fashion on the drawing board, said universal parallel ruler comprising:

a first reader means for reading a rotation angle $\theta_1$ of the first arm relative to one of said bases; a second reader means for reading a rotation angle $\theta_2$ of the second arm relative to the second base and the head;

a third reader means for reading a tilt angle $\theta$ of the scales relative to the head;

an arithmetic unit means for determining a parallel displacement amount of the scales based on the rotation angles $\theta_1$, $\theta_2$ and the tilt angle $\theta$ read by said reader means; and display means for displaying the parallel displacement amount of the scales in a digital manner.

2. An arm type universal parallel ruler with a converted display of displacement and having a first base fixed to a drawing board, a first arm rotatably supported at one end by said first base, a second base mounted on the opposite end of said first arm and connected by a translation mechanism to said first base, a second arm rotatably supported at one end by said second base, a head mounted on the opposite end of said second arm and connected by said translation mechanism to said second base and scales rotatably and fixably mounted on said head, said scales capable of being displaced in a parallel fashion on a drawing board, said universal parallel ruler comprising:

a first reader means for reading a rotation angle $\theta_1$, of the first arm relative to one of said bases;

a second reader means for reading a rotation angle $\theta_2$ of the second arm relative to the second base and the head;

a third reader means for reading a tilt angle $\theta$ of the scales relative to the head;

an arithmetic unit means for determining a parallel displacement amount of the scales based on said rotation angles $\theta_1$, $\theta_2$ and the tilt angle $\theta$ read by said reader means;

scale setting means associated with said arithmetic unit for setting a scale for display of displacement data in a modified unit dimension; and display means for displaying the scale displacement in said modified unit dimension.

3. An arm type universal parallel ruler with converted display or displacement according to claim 1 or 2 further comprising:

reset means for resetting the displacement amount obtained by said reader means and arithmetic unit means to a desired scale position to correspond to a standard position for displacement.

* * * * *

UNITED STATES PATENT AND TRADEMARK OFFICE

CERTIFICATE OF CORRECTION

PATENT NO. : 4,270,277

DATED : June 2, 1981

INVENTOR(S) : Koenuma

It is certified that error appears in the above—identified patent and that said Letters Patent is hereby corrected as shown below:

In the category entitled "[30] Foreign Application Priority Data", change "Apr. 12, 1978" to --Apr. 10, 1978--

Signed and Sealed this

*Thirteenth* Day of *October 1981*

[SEAL]

*Attest:*

GERALD J. MOSSINGHOFF

*Attesting Officer*

*Commissioner of Patents and Trademarks*